US006459195B1

(12) United States Patent
Ono

(10) Patent No.: US 6,459,195 B1
(45) Date of Patent: Oct. 1, 2002

(54) FE-CR-NI ALLOY ELECTRON GUN ELECTRODED AND FE-CR-NI ALLOY SHEET FOR ELECTRON GUN ELECTRODES

(75) Inventor: Toshiyuki Ono, Kanagawa (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 215 days.

(21) Appl. No.: 09/640,397

(22) Filed: Aug. 17, 2000

(30) Foreign Application Priority Data

Sep. 28, 1999 (JP) ..... 11-274902
Jun. 26, 2000 (JP) ..... 2000-191157

(51) Int. Cl.[7] ..... C22C 38/40

(52) U.S. Cl. ..... 313/412; 148/327; 148/325; 148/326

(58) Field of Search ..... 313/412; 148/327, 148/325, 326; 420/43, 44, 45

(56) References Cited

FOREIGN PATENT DOCUMENTS

| | | |
|---|---|---|
| JP | A-8-176751 | 7/1996 |
| JP | A-9-268352 | 10/1997 |
| JP | A-11-12690 | 1/1999 |

*Primary Examiner*—Vip Patel
*Assistant Examiner*—Ken A. Berck
(74) *Attorney, Agent, or Firm*—Arent Fox Kintner Plotkin & Kahn PLLC

(57) ABSTRACT

An Fe—Cr—Ni alloy for electron gun electrodes, comprises: 15 to 20% Cr; 9 to 15% Ni; 0.12% or less C; 0.005 to 1.0% Si; 0.005 to 2.5% Mn; 0.03% or less P; 0.0010 to 0.0100% S; 2.0% or less Mo; 0.001 to 0.2% Al; 0.005% or less O; 0.1% or less N; 0.05% or less Ca; 0.02% or less Mg; balance Fe; inevitable impurities; and inclusions with lengths of 10 $\mu$m or more and less than 100 $\mu$m and with an average distance therebetween of 100 $\mu$m or less in the thickness direction and inclusions with lengths of less than 10 $\mu$m and with an average distance therebetween of 20 $\mu$m or less in the thickness direction when the alloy is rolled to a sheet with a thickness in the range of 0.1 to 0.7 mm.

6 Claims, 4 Drawing Sheets

Press Punching Surface with Good Linearity at Boundary of Shearing Surface and Fracture Surface Press Punching Surface with Bad Linearity at Boundary of Shearing Surface and Fracture Surface

FE-CR-NI ALLOY ELECTRON GUN ELECTRODED AND FE-CR-NI ALLOY SHEET FOR ELECTRON GUN ELECTRODES

BACKGROUND OF THE INVENTION

This invention relates to an Fe—Cr—Ni alloy suitable as material for electron gun parts, such as electrodes for electron gun parts, which has improved punching properties, and in particular, has superior linearity at the boundary of a shearing surface and a fracture surface at a punched surface.

FIG. 1 shows a cross section of a color cathode ray tube of the shadow mask type already known in the art. A panel 1 is coated on the back side with a phosphor film 2 that generates the three primary colors red, green, and blue. An electron gun 4 that emits electron beams 3 is housed in the neck. The electron beams 3 are deflected in scanning by a deflection yoke 5. The reference numeral 6 indicates a shadow mask and the reference numeral 7 indicates a magnetic shield.

FIGS. 2A and 2B are perspective and cross sectional views, respectively, of a grid electrode 10 as an example of a punched part to be fitted in the electron gun 4. The electrode 10 acts to control electrons emitted from a cathode in the electron gun, and acts to form electron beams and to modulate electron current. The electrode has small holes 10*a*, 10*b*, and 10*c* made by coining and punching so as to allow red, green, and blue color-generating beams, respectively, to pass through them.

In general, the electron gun electrodes for use in cathode ray tubes and the like are completed by press punching, with or without coining, a sheet of nonmagnetic stainless steel about 0.1 to 0.7 mm thick. The press punching among these processings, however, presents a burr formation problem. That is, as materials are punched with a pattern of through holes for passing beams therethrough, for example, 10*a*, 10*b*, and 10*c* each, burrs B are formed on the edges 10*e* of the holes where punches have forced slugs down and cut them off from the blank (see FIG. 2). The burrs have adverse effects on the control of the electron beams, sometimes causing total failure of the electron guns. Therefore, it has been desired to remove burrs.

Although barrel polishing or chemical polishing has been applied after press punching for removing burrs, these optional processings increase the production cost. Furthermore, in barrel polishing, the burrs fall and project into the transmission hole for the beams, and it has therefore been desired that the burrs not remain after press punching.

Improvements in the punching properties of nonmagnetic stainless steel have hitherto been proposed. Japanese Patent Application, First Publication, No. 268352/97 proposes to form a work hardening layer in a surface portion. However, the mere hardening of the surface portion cannot continuously propagate cracks formed by shearing in the thickness direction of the sheet, and is not sufficient to control of burrs in press punching the transmission holes for electron beams.

Japanese Patent Application, First Publication, No. 176571/96 proposes to specify the S content within 0.0010 to 0.050% thereby dispersing S or S compounds along grain boundaries or within grains in the alloy stock. Japanese Patent Application, First Publication, No. 12690/99 proposes to combine specifying the S content and surface hardening. However, the mere addition of S, a free-cutting element, in a specified percentage cannot be deemed adequate for the control of burrs in the case of production processes. Addition of S for a free-cutting element increases the thickness fraction of fracture surface in a punched surface. However, the boundary of the shearing surface and the fracture surface waves as shown in FIG. 3B, and the parallel portion of the transmission hole for electron beams is shortened as shown in FIG. 4, and the punching properties are therefore not sufficient for electrodes required to have the most precise specifications for fine control of electric field. It should be noted that the surface hardening may be an adverse effect for drawing which is performed to a certain extent through working of electron gun electrodes, in addition to increase in the of steps and production cost.

BRIEF SUMMARY OF THE INVENTION

This invention has an object to solve the aforementioned problems of the prior art and to provide an Fe—Cr—Ni alloy for electron gun electrodes and an Fe—Cr—Ni alloy sheet for electron gun electrodes which are improved in punching properties, in particular, in the linearity at the boundary of the shearing surface and the fracture surface in the punched surface.

The inventors have intensively studied the influences of inclusions and the distribution thereof for the purpose of reducing the thickness fraction of the fracture surface in punched surfaces and improving the linearity at the boundary of a shearing surface and a fracture surface in a punched surface. As a result, the inventors have found that materials, which can satisfy the most precise specifications for electron beam transmission holes of electron gun electrodes without formation of burrs, can be produced by restricting the average distance in the thickness direction of the sheet between inclusions to the specific value or less according to the length of the inclusions and by restricting the inclusions within the specific compositions.

In particular, it has been demonstrated that although inclusions typified by MnS effectively contribute to initiation and propagation of cracks in shearing, cracks initiate too quickly and the width of the shearing surface is narrow compared to other portions if the length of the inclusion is too long, and as a result, this causes a wave at the boundary of a shearing surface and a fracture surface in a punched surface of transmission holes. Furthermore, the inventors have found that the linearity at the boundary of a shearing surface and a fracture surface in a punched surface is good even if inclusions with lengths of 100 $\mu$m or more exist by forming inclusions with lengths of 10 $\mu$m or more and less than 100 $\mu$m and with an average distance therebetween in the thickness direction of 100 $\mu$m or less, and by forming inclusions with lengths of less than 10 $\mu$m and with an average distance therebetween in the thickness direction of 20 $\mu$m or less when the thickness of the sheet is in the range of 0.1 to 0.7 mm.

Furthermore, the inventors have found that the linearity at the boundary of a shearing surface and a fracture surface in a punched surface can be further improved by specifying the chemical composition of inclusions with lengths of less than 10 $\mu$m in $40 \leqq SiO_2 \leqq 100$, $0 \leqq Al_2O_3 \leqq 40$, and $0 \leqq Mn \leqq 30$ by atomic %.

The average distance between inclusions in the thickness direction is measured by the method described below. First, a sheet rolled to a thickness of 0.1 to 0.7 mm is cut along the rolling direction, and the cross section along the rolling direction is specularly polished and then electropolished in phosphoric acid so as to facilitate distinction of inclusions. When an average distance in the thickness direction between inclusions with lengths of 10 $\mu$m or more and less than 100 $\mu$m is measured, a region defined by the thickness of the sheet and length of 100 μm in the rolling direction is set, and the number of inclusions, which have lengths of 10 μm or more and less than 100 μm and at least a portion thereof overlaps with the region, is counted. The average distance is obtained by dividing the number of inclusions with thickness of the sheet. In the case of inclusions with length of less than 10 μm, a region defined by the thickness of the sheet and length of less than 10 μm in the rolling direction is set, and the number of inclusions, which have lengths of less than 10 μm and at least a portion thereof overlaps with the region, is counted. The average distance is obtained by dividing the number of the inclusions with the thickness of the sheet. The average distances are measured at ten random portions, and the average thereof is obtained as an average distance of inclusions with lengths of 10 μm or more and less than 100 μm or an average distance with lengths of less than 10 μm.

The chemical composition of the inclusions with length of less than 10 μm is obtained by quantitative analysis with an electron beam microanalizer on ten inclusions chosen randomly.

It should be noted that sulfide type inclusions are included in the inclusions with lengths of 10 μm or more and less than 100 μm in the sheet with a thickness of 0.1 to 0.7 mm. In order to control the length of inclusions, the temperature in hot working is adjusted according to the content of elements typified by Mn and Ca for forming sulfide type inclusions, thereby inhibiting excessive growth of sulfide type inclusions, decomposition, and elimination thereof, and shortage of sulfide type inclusions with lengths of 10 μm or more due to less growth thereof.

The Fe—Cr—Ni alloy for electron gun electrodes of the invention has been made based on the above knowledge, and characterized in comprising: 15 to 20% Cr; 9 to 15% Ni; 0.12% or less C; 0.005 to 1.0% Si; 0.005 to 2.5% Mn; 0.03% or less P; 0.0010 to 0.0100% S; 2.0% or less Mo; 0.001 to 0.2% Al; 0.005% or less O; 0.1% or less N; 0.05% or less Ca; 0.02% or less Mg by weight; balance Fe; inevitable impurities; and inclusions with lengths of 10 μm or more and less than 100 μm and with an average distance therebetween of 100 μm or less in the thickness direction and inclusions with lengths of less than 10 μm and with an average distance therebetween of 20 μm or less in the thickness direction when the alloy is rolled to a sheet with a thickness in the range of 0.1 to 0.7 mm.

According to the preferred embodiment of the invention, the above Fe—Cr—Ni alloy for electron gun electrodes may be specified by the chemical composition of inclusions with lengths of less than 10 μm in cross section along the rolling direction of the sheet with a thickness in the range of 0.1 to 0.7 μm in $40 \leqq SiO_2 \leqq 100$, $0 \leqq Al_2O_3 \leqq 40$, and $0 \leqq MnO \leqq 30$ by atomic %.

Furthermore, the invention provides an Fe—Cr—Ni alloy sheet for electron gun electrodes obtained by rolling the above Fe—Cr—Ni alloy for electron gun electrodes to a thickness in the range of 0.1 to 0.7 mm.

In the following, the reasons of the above numerical limitations will be explained. In the following explanation, "%" means "weight %".

(Cr): Electron gun electrodes are required to be nonmagnetic, and magnetic permeability is required to be 1.005 or less to be nonmagnetic. In order to meet the requirement, the content of Cr is restricted to within the range of 15 to 20%. The Cr content is preferably in the range of 15 to 17%.

(Ni): If the content of Ni is less than 9%, magnetism is excessively imparted. If the Ni content is more than 15%, the material cost is relatively high. Hence, the Ni content is restricted to within the range of 9 to 15%.

(C): If the content of C is more than 0.12%, carbides excessively precipitate and drawing properties are inferior. Hence, the C content is restricted to 0.12% or less.

(Si): Si is added for deoxidation. If the Si content is less than 0.005%, the effect as a deoxidizer cannot be obtained. On the other hand, if the Si content is more than 1.0%, the formability is inferior. Hence, the Si content is restricted to within the range of 0.005 to 1.0%.

(Mn): Mn is added for deoxidation and formation MnS. If the Mn content is less than 0.005%, these effects are not expected. If the Mn content is more than 2.5%, the hardness of the alloy markedly increases, and thereby the drawing properties are inferior. Hence, the Mn content is restricted to within the range of 0.005 to 2.5%.

(P): If the P content is more than 0.03%, the drawing properties are very inferior. Hence, the P content is restricted to 0.03% or less.

(S): When contained in an appropriate amount, S forms MnS together with Mn, thereby inhibiting formation of burrs in press punching holes and generation of burring cracks in burring. If the S content is less than 0.0010%, such effects are not expected. If the S content is more than 0.0100%, coarse MnS is already formed in casting, thereby the hot working properties and drawing properties are inferior. Hence, the S content is restricted to within the range of 0.0010 to 0.0100%.

(Mo): Since Mo improves corrosion resistance, Mo may be advantageously added when special corrosion resistance is required. However, if the Mo content is more than 2.0%, the formability is inferior. Hence, the Mo content is restricted to 2.0% or less.

(Al): Al is added for deoxidation. If the Al content is less than 0.001%, the effect as a deoxidizer can not be obtained. On the other hand, if the Al content is more than 0.2%, the formability is inferior. Hence, the Al content is restricted to within the range of 0.001 to 0.02%.

(O): When a large amount of O is contained, the amount of oxide-type inclusions increase, thereby forming composite inclusions with sulfides, and the amount of S effective for improving the punching properties is sometimes decreased. Hence the 0 content is restricted to 0.005% or less.

(N): If the N content is more than 0.1%, the formability is inferior. Hence, the N content is restricted to 0.1% or less.

(Ca): Ca forms sulfides and improves the punching properties. However, Ca readily form composite inclusions of sulfides and oxides, which are not very effective for punching properties and the drawing properties are inferior. Hence, the Ca content is restricted to 0.05% or less, and more preferably the Ca content is 0.01% or less.

(Mg): Mg forms oxides, thereby the formability is inferior. Hence, the Mg content is restricted to 0.02% or less, and more preferably the Mg content is 0.005% or less.

(Average Distance between Inclusions in Thickness Direction when Sheet is Worked to 0.1 to 0.7 mm Thick):

If the average distance in the thickness direction between inclusions with lengths of 10 μm or more and less than 100 μm is more than 100 μm, initiation of cracks in shearing may easily be nonuniform, whereby the boundary of a shearing surface and a fracture surface in a punched surface is wavy. Hence, the average distance in the thickness direction between inclusions with lengths of 10 μm or more and less than 100 μm is restricted to 100 μm or less. Furthermore, when the average distance in the thickness direction between inclusions with lengths of less than 10 μm is more than 20 μm, the propagation of cracks is inhibited, so that small shearing surface flows at the boundary of a shearing surface and a fracture surface in a punche-d surface, and thereby linearity thereof is inferior. Hence, the average distance in the thickness direction between inclusions with lengths of less than 10 μm is restricted to 20 μm or less. It should be noted that the inclusions referred in the invention include not only a single inclusion but also a group of inclusions lined in the rolling direction.

(Composition of Inclusions): If the chemical compositions of inclusions with lengths of less than 10 μm are outside the ranges of $40 \leqq SiO_2 \leqq 100$, $0 \leqq Al_2O_3 \leqq 40$, and $0 \leqq MnO \leqq 30$ by atomic %, composite inclusions of oxides and sulfides are formed, or hard inclusions are formed, whereby the linearity at the boundary of a shearing surface and a fracture surface is readily disturbed. Hence, the chemical compositions of inclusions with lengths of less than 10 μm are preferably restricted to within the ranges of $40 \leqq SiO_2 \leqq 100$, $0 \leqq Al_2O_3 \leqq 40$, and $0 \leqq MnO \leqq 30$ by atomic %.

DETAILED DESCRIPTION OF THE INVENTION

EXAMPLES

Figure 1:
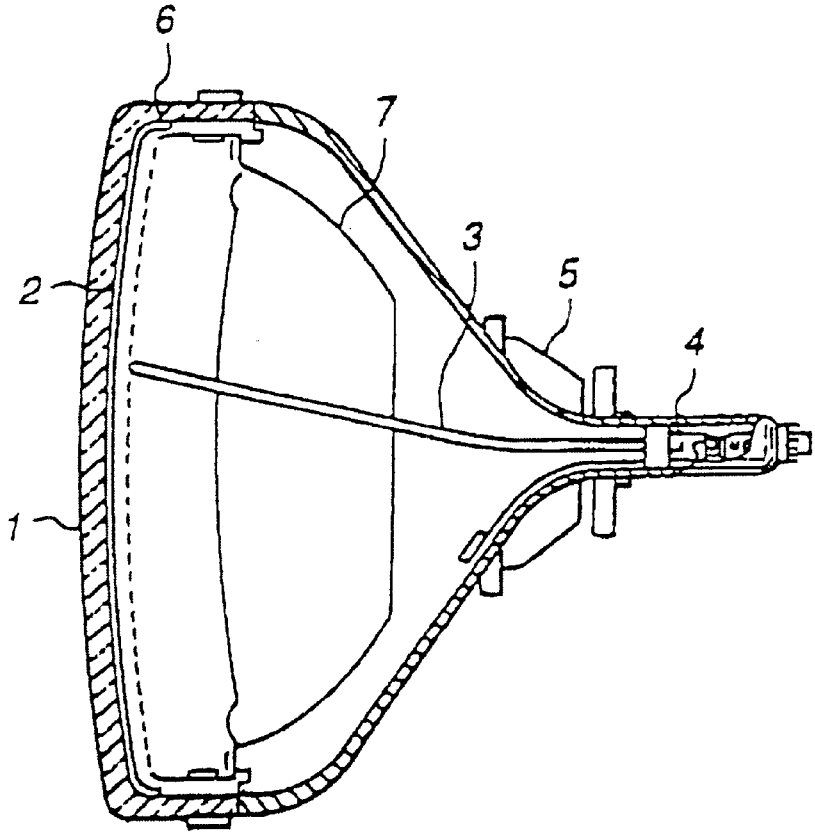
FIG. 1 is a cross sectional view of a shadow mask type cathode ray tube.
Figure 2A:
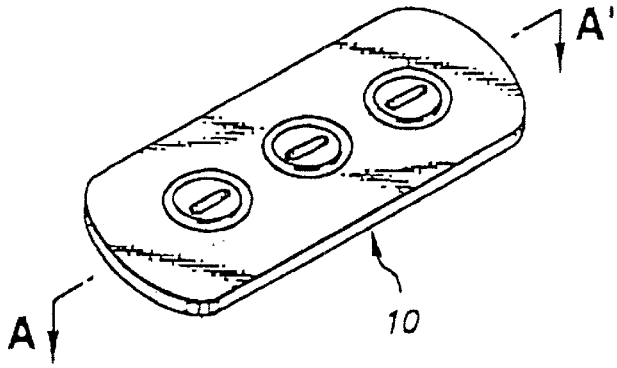
FIG. 2 A is a perspective view of an electrode for an electron gun as an example of punched part according to this invention and FIG. 2B is cross sectional view taken along the line A–A' in FIG. 2A.
Figure 2B:
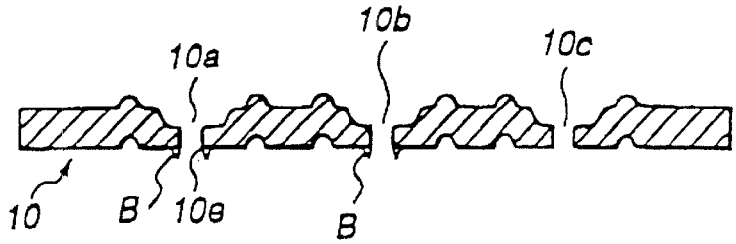

The present invention will be explained referring to the following description of examples of the invention and comparative examples. Sample materials were melted and cast by continuous casting so as to impart the chemical compositions as shown in Table 1. In the process, in order to adjust the compositions of inclusions, Sample No. 10 was subjected to strong deoxidizing with Al, Sample No. 12 was subjected to deoxidizing with Si, Mn, and C without Al, Sample No. 5 was subjected to deoxidizing with Si, Mn, and C with a small amount of Al, and the other samples were subjected to deoxidizing with Si and Al. Then, Samples Nos. 7 and 8 were heated to temperatures of 1280 to 1300° C. and the other samples were heated to temperatures of 11880 to 1230° C., and they were then subjected to blooming and peeling. The samples were heated to the same temperature and hot rolled, and they were then descaled and repeatedly cold rolled and annealed to 0.33 mm thick annealed sheets and 0.5 mm thick annealed sheets.

TABLE 1

| No. | C | Si | Mn | P | S | Ni | Cr | Cu | Al | Mo | N | O | Ca | Mg |
|---|---|---|---|---|---|---|---|---|---|---|---|---|---|---|
| 1 | 0.036 | 0.63 | 1.59 | 0.025 | 0.0034 | 14.20 | 16.11 | 0.05 | 0.0017 | 0.05 | 0.0445 | 0.0025 | 0.002 | 0.002 |
| 2 | 0.045 | 0.59 | 0.92 | 0.018 | 0.0026 | 12.28 | 17.53 | 0.08 | 0.0022 | 0.02 | 0.0250 | 0.0029 | 0.002 | 0.001 |
| 3 | 0.043 | 0.67 | 0.45 | 0.031 | 0.0052 | 14.09 | 15.77 | 0.16 | 0.0051 | 0.08 | 0.0200 | 0.0023 | 0.003 | 0.002 |
| 4 | 0.047 | 0.53 | 1.14 | 0.026 | 0.0028 | 14.19 | 16.13 | 0.08 | 0.0032 | 0.06 | 0.0288 | 0.0026 | 0.001 | 0.002 |
| 5 | 0.036 | 0.60 | 1.52 | 0.025 | 0.0025 | 14.07 | 15.84 | 0.04 | 0.0058 | 0.01 | 0.0360 | 0.0031 | 0.002 | 0.002 |
| 6 | 0.061 | 0.51 | 0.98 | 0.028 | 0.0035 | 13.97 | 15.77 | 0.09 | 0.0069 | 0.07 | 0.0366 | 0.0048 | 0.003 | 0.003 |
| 7 | 0.054 | 0.49 | 1.97 | 0.021 | 0.0015 | 12.19 | 16.37 | 0.19 | 0.0032 | 0.09 | 0.0437 | 0.0047 | 0.003 | 0.003 |
| 8 | 0.052 | 0.51 | 2.28 | 0.022 | 0.0017 | 12.22 | 16.30 | 0.18 | 0.0041 | 0.12 | 0.0420 | 0.0055 | 0.003 | 0.002 |
| 9 | 0.047 | 0.51 | 0.47 | 0.026 | 0.0043 | 13.97 | 15.77 | 0.05 | 0.0380 | 0.07 | 0.0375 | 0.0013 | 0.002 | 0.002 |
| 10 | 0.038 | 0.62 | 1.39 | 0.023 | 0.0079 | 14.28 | 16.14 | 0.06 | 0.0350 | 0.04 | 0.0445 | 0.0011 | 0.001 | 0.002 |
| 11 | 0.035 | 0.64 | 1.11 | 0.019 | 0.0024 | 14.25 | 16.12 | 0.05 | 0.0088 | 0.05 | 0.0445 | 0.0015 | 0.001 | 0.002 |
| 12 | 0.042 | 0.61 | 1.48 | 0.026 | 0.0013 | 14.25 | 15.84 | 0.04 | 0.0015 | 0.05 | 0.0297 | 0.0082 | 0.002 | 0.001 |

TABLE 2

| No. | Average Distance in the Thickness Direction Between Inclusions with Length of 10 μm or more and less than 100 μm (μm) | Average Distance in the Thickness Direction Between Inclusions with Lengths less than 10 μm (μm) | Composition of Inclusions (at %) $SiO_2$ | $Al_2O_3$ | MnO | |
|---|---|---|---|---|---|---|
| 1 | 65 | 17 | 45~52 | 12~18 | 18~26 | Example |
| 2 | 55 | 18.4 | 52~58 | 21~27 | <1 | of the |
| 3 | 77 | 14.2 | >98 | <1 | <1 | Invention |
| 4 | 46 | 13.6 | 57~72 | 15~21 | 8~13 | |
| 5 | 67 | 14.6 | 48~52 | <3 | 44~49 | |
| 6 | 87 | 16.8 | 31~38 | 52~55 | 8~14 | |
| 7 | 107 | 18.8 | 45~55 | 21~27 | 18~21 | Comparative |
| 8 | 121 | 14.2 | >97 | <1 | <1 | Example |
| 9 | 71 | 23.6 | 42~47 | 19~23 | <1 | |
| 10 | 65 | 31.4 | <1 | >99 | <1 | |
| 11 | 84 | 25.4 | 32~38 | 50~57 | 8~14 | |
| 12 | 110 | 17.4 | 48~67 | <1 | 32~51 | |

The average distance in the thickness direction between inclusions in the annealed sheets and chemical compositions of the inclusions are shown in Table 2. In the tables, Samples Nos. 1 to 6 were examples of the invention, and in particular, Samples Nos. 1 to 4 relate a particular aspect of the invention. Samples Nos. 7 to 12 are comparative examples. Although $SiO_2$, $AlO_3$, and MnO are shown by Table 2 to be inclusions included in the annealed sheet, inclusions other than these three types may be included.

The sheets were cold rolled at a degree of rolling reduction of 30% and punched with a 0.4 mm diameter punch. An average of the thickness fraction of fracture surface (the ratio of the thickness of fracture surface to that of the total thickness) was measured with respect the portions of the punched surface in the rolling direction and the transverse direction to the rolling direction of the ten punched holes of each sheet. It has been demonstrated that formation of burrs is inhibited as the thickness fraction of fracture surface is large. The average value of the ratio of the maximum difference between a ridge and a valley which are observed in side view of the punched surface at the boundary of the shearing surface and the fracture surface to the total thickness were measured. The linearity of at the boundary of a shearing surface and a fracture surface was inferior when the ratio is large, and the boundary waves when the ratio were remarkably large. The results of the measurement are shown in Table 3.

TABLE 3

| No. | Thickness mm | Thickness Fraction of Fracture Surface (%) Rolling Direction | Transverse to Rolling Direction | Maximum Difference Between Ridge and Valley at Boundary of Shearing Surface and Fracture Surface (%) Direction | Transverse to Rolling Direction | |
|---|---|---|---|---|---|---|
| 1 | 0.50 | 25.1 | 23.8 | 8.9 | 7.2 | Example of the Invention |
| 2 | 0.33 | 28.2 | 27.5 | 6.3 | 5.8 | |
| 3 | 0.50 | 24.7 | 24.6 | 7.5 | 5.9 | |
| 4 | 0.25 | 28.8 | 28.5 | 8.2 | 6.7 | |
| 5 | 0.40 | 27.8 | 27.2 | 10.8 | 8.9 | |
| 6 | 0.60 | 24.7 | 22.5 | 9.8 | 8.3 | |
| 7 | 0.33 | 26.2 | 24.1 | 20.2 | 10.2 | Comparative Example |
| 8 | 0.50 | 25.2 | 22.8 | 20.7 | 10.5 | |
| 9 | 0.50 | 25.5 | 24.8 | 17.2 | 13.3 | |
| 10 | 0.60 | 29.7 | 28.9 | 14.8 | 12.2 | |
| 11 | 033 | 25.6 | 24.1 | 12.8 | 10.5 | |
| 12 | 0.40 | 20.3 | 20.8 | 18.8 | 16.6 | |

Figure 3A:
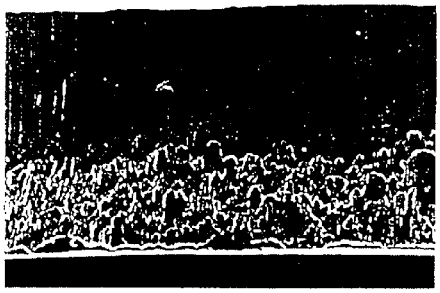
FIG. 3A is a drawing showing a punched surface in which the linearity at the boundary of the shearing surface and the fracture surface is good.
Figure 3B:
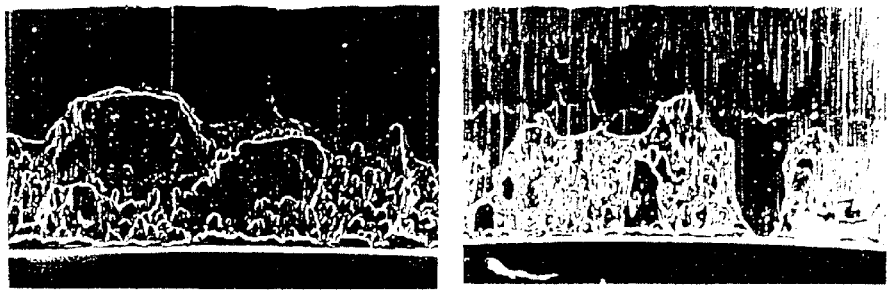
FIG. 3B is a drawing showing a punched surface in which the linearity at the boundary of the shearing surface and the fracture surface is no good.
Figure 4:
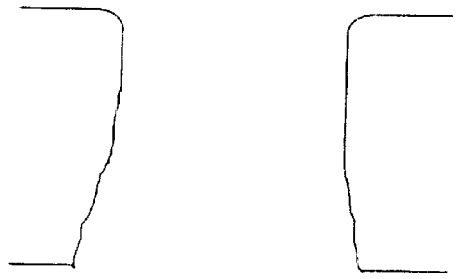
FIG. 4 is a schematic view showing a cross section of an electron beam transmission hole, in which a wave shown in FIG. 3B occurred.

As is shown in Tables 2 and 3, in all the Samples Nos. 1 to 6 in which the average distance between inclusions with lengths of 10 μm or more and less than 100 μm is 100 μm or less and the average distance between inclusions with lengths of less than 10 μm is 20 μm or less, which is limited in the invention, the ratio of the maximum difference between a ridge and a valley at the boundary of a shearing surface and a fracture surface to the total thickness was small with respect to the thickness fraction of fracture surface in the punched hole, and the linearity at the boundary of a shearing surface and a fracture surface was superior. FIG. 3A shows a typical punched surface thereof. In Samples Nos. 5 and 6 among those, since the compositions of inclusions were outside the range of the invention, the ratio of the maximum difference between a ridge and a valley at the boundary of a shearing surface and a fracture surface to the total thickness was relatively large.

In contrast, in Samples Nos. 8 and 12 in which the average distance between inclusions is outside the range of the invention, since the average distance between inclusions with lengths of 10 μm or more and less than 100 μm was large, the linearity at the portion of the cross section in the rolling direction was inferior. In Samples Nos. 9 to 11, since the average distance between inclusions with lengths of less than 10 μm was large, the linearity at the portions of the cross section in the rolling direction and the transverse direction to the rolling direction was inferior. The thickness fraction of fracture surface in Samples Nos. 7 to 12 was only two times the ratio of the maximum difference between a ridge and a valley at the boundary of a shearing surface and a fracture surface to the total thickness, and there is concern that in samples, the shearing surface may penetrate the fracture surface. In Sample No. 10, since the S content is large (0.0079 weight %), the average distance between inclusions with lengths of 10 μm and less than 100 μm is small (65 μm). However, since the Sample No. 10 was subjected to strong deoxidization with Al, the amount of oxide type inclusions is small, so that the average distance between inclusions with lengths of less than 10 μm is large (31.4 μm). As a result, the linearity is inferior, and the punched surface was not satisfactory as electron transmission hole.

As explained in the above, in the Fe—Cr—Ni alloy for electron gun electrodes, punching properties can be extremely improved for electron gun electrodes, and electron transmission holes with superior linearity at the boundary of the shearing surface and the fracture surface in punched surface can be punched even if the working is performed in demanding condition, and it is therefore very effective for the Fe—Cr—Ni alloy for electron gun electrodes.

What is claimed is:

1. An Fe—Cr—Ni alloy for electron gun electrodes, comprising: 15 to 20% Cr; 9 to 15% Ni; 0.12% or less C; 0.005 to 1.0% Si; 0.005 to 2.5% Mn; 0.03% or less P; 0.0010 to 0.0100% S; 2.0% or less Mo; 0.001 to 0.2% Al; 0.005% or less O; 0.1% or less N; 0.05% or less Ca; 0.02% or less Mg by weight; balance Fe; inevitable impurities; and inclusions with lengths of 10 μm or more and less than 100 μm and with an average distance therebetween of 100 μm or less in the thickness direction and inclusions with lengths of less than 10 μm and with an average distance therebetween of 20 μm or less in the thickness direction when the alloy is rolled to a sheet with a thickness in the range of 0.1 to 0.7 mm.

2. An Fe—Cr—Ni alloy for electron gun electrodes, according to claim 1, wherein the alloy is rolled to a sheet with a thickness in the range of 0.1 to 0.7 mm, and the inclusions with lengths of less than 10 $\mu$m along the rolling direction have chemical compositions of $40 \leqq SiO_2 \leqq 100$, $0 \leqq Al_2O_3 \leqq 40$, and $0 \leqq MnO \leqq 30$ by atomic %.

3. An Fe—Cr—Ni alloy sheet for electron gun electrodes, wherein the sheet is obtained by using the Fe—Cr—Ni alloy for electron gun electrodes, according to claim 1 and has a thickness in the range of 0.1 to 0.7 mm.

4. An Fe—Cr—Ni alloy for electron gun electrodes, according to claim 1, wherein the Cr content is in the range of 15 to 17% by weight.

5. An Fe—Cr—Ni alloy for electron gun electrodes, according to claim 1, wherein the Ca content is 0.01% or less by weight.

6. An Fe—Cr—Ni alloy for electron gun electrodes, according to claim 1, wherein the Mg content is 0.005% or less by weight.

* * * * *